US012276176B2

(12) United States Patent
Almusallam

(10) Patent No.: US 12,276,176 B2
(45) Date of Patent: Apr. 15, 2025

(54) ASSEMBLY AND GRIPPER USED THEREIN

(71) Applicant: SAUDI ARABIAN OIL COMPANY, Dhahran (SA)

(72) Inventor: Ali A. Almusallam, Al Mubarraz (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 60 days.

(21) Appl. No.: 18/162,138

(22) Filed: Jan. 31, 2023

(65) Prior Publication Data

US 2024/0254856 A1 Aug. 1, 2024

(51) Int. Cl.
*E21B 33/134* (2006.01)
*E21B 29/00* (2006.01)

(52) U.S. Cl.
CPC ..... *E21B 33/134* (2013.01); *E21B 29/002* (2013.01)

(58) Field of Classification Search
CPC ..... E21B 33/134; E21B 29/002; E21B 34/14
See application file for complete search history.

(56) References Cited

U.S. PATENT DOCUMENTS

2014/0166317 A1* 6/2014 Gregory ..... E21B 33/134 166/387

FOREIGN PATENT DOCUMENTS

EP 3 347 564 B1 11/2019

* cited by examiner

*Primary Examiner* — Nicole Coy
*Assistant Examiner* — Nicholas D Wlodarski
(74) *Attorney, Agent, or Firm* — Osha Bergman Watanabe & Burton LLP

(57) ABSTRACT

An assembly comprises a downhole tool and a gripper. The downhole tool is configured to be set in a wellbore and milled after a scheduled period, wherein the downhole tool has a first tool end and a second tool end along a longitudinal direction. The gripper is positioned opposite the first tool end along the longitudinal direction, wherein the gripper comprises a slider and an activator. The activator is configured to be moved by the downhole tool relative to the slider between an inactivated position and an activated position when the downhole tool is milled from the second tool end. The slider remains unmoved when the activator is in the inactivated position, and the slider moves radially to engage with an internal wall of the wellbore and stop the downhole tool from rotation when the activator is in the activated position.

18 Claims, 6 Drawing Sheets

ASSEMBLY AND GRIPPER USED THEREIN

BACKGROUND

In oil and gas industry, a variety of downhole tools are used for manufacturing, operation, maintenance, or other operation of a wellbore. Some of these tools may be non-permanent and will be dissolved, milled, or otherwise removed after a period of usage.

One example of a downhole tool is a bridge plug, which can be used to seal and isolate certain sections of a drilled well from other sections of the well. Prior to any mechanical work-over operation or perforating more perforation intervals of a reservoir, the existing well is temporarily isolated to prevent formation damage. For such applications, bridge plugs are commonly used and set in the downhole. A single bridge plug might not suffice as it frequently fails the pressure test and hence another bridge plug must be set. Upon completion of the required operation, those bridge plugs are milled to restore well accessibility and resume production. High-pressure coil tubing (HPCT) is typically used to mill these bridge plugs.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an assembly comprising a downhole tool and a gripper. The downhole tool is configured to be set in a wellbore and milled after a scheduled period, wherein the downhole tool has a first tool end and a second tool end along a longitudinal direction. The gripper is positioned opposite the first tool end along the longitudinal direction, wherein the gripper comprises a slider and an activator. The activator is configured to be moved by the downhole tool relative to the slider between an inactivated position and an activated position when the downhole tool is milled from the second tool end. The slider remains unmoved when the activator is in the inactivated position, and the slider moves radially to engage with an internal wall of the wellbore and stop the downhole tool from rotation when the activator is in the activated position.

In another aspect, embodiments disclosed herein relate to a gripper for use with a downhole tool, wherein the downhole tool is configured to be set in a wellbore and milled after a scheduled period and has a first tool end and a second tool end along a longitudinal direction. The gripper comprises an activator and a slider. The activator is configured to be moved by the downhole tool between an inactivated position and an activated position when the downhole tool is milled from the second tool end. The slider is configured to remain in the gripper when the activator is in the inactivated position and move to engage with an internal wall of the wellbore and stop the downhole tool from rotation when the activator is in the activated position.

In a further aspect, embodiments disclosed herein relate to a method for isolating a section from another section in a wellbore for a scheduled period. The method comprises deploying at a predetermined position in the wellbore a bridge plug with a gripper fixed to a first end of the bridge plug, wherein the gripper comprises an activator and a slider. The method further comprises milling, after the scheduled period, from a second end of the bridge plug such that the activator is moved by the bridge plug from an inactivated position to an activated position, wherein the slider remains unmoved when the activator is in the inactivated position, and the slider moves radially to engage with an internal wall of the wellbore and stop the bridge plug from rotation when the activator is in the activated position.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
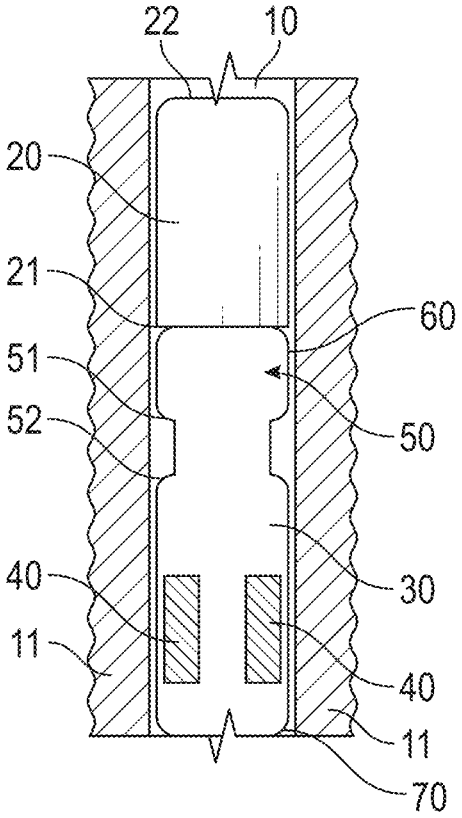
FIG. 1 shows a schematic view of an assembly according to one or more embodiments, in which the assembly comprising a downhole tool and a gripper is deployed in a wellbore.

In the following detailed description of embodiments of the disclosure, numerous specific details are set forth to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of example, a first element is distinct from a second element, and the first element may encompass more than one element and succeed (or precede) the second element in an ordering of elements.

In the following description of FIGS. 1-10, any component described regarding a figure, in various embodiments disclosed herein, may be equivalent to one or more like-named components described with regard to any other figure. For brevity, descriptions of these components may not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a slider" includes reference to one or more of such slider.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Generally, an assembly according to one or more embodiments comprises a downhole tool and a gripper. The downhole tool has a first tool end and a second tool end along a longitudinal direction. The gripper is positioned opposite the first tool end of the downhole tool along the longitudinal direction and comprises a slider and an activator. The activator is configured to move relative to the slider between an inactivated position and an activated position when the downhole tool is milled from the second tool end so that the slider moves radially to engage with an internal wall of a wellbore and stop the downhole tool from rotation.

The gripper can be configured as a part of the downhole tool or a separate accessory which will be fixed to the first tool end of the downhole tool before deployment in a wellbore.

In one or more embodiments, a driver may be included in the assembly for transforming at least one of the rotation and the linear movement of the downhole tool into the movement of the activator between the inactivated position and the activated position when the downhole tool is milled from the second tool end. As an example, the driver includes a pusher which is configured to push the activator from the inactivated position to the activated position when the downhole tool is milled from the second end of the downhole tool. As another example, the driver may include a screw rod which is configured to transform the rotation of the downhole tool into the relative movement between the activator and the slider.

FIG. 1 shows a schematic view of an assembly according to one or more embodiments, which assembly is used for deployment in a wellbore 10 for operations like drilling, manufacturing, or maintenance of the wellbore. The assembly comprises a downhole tool 20 and a gripper 30 connected to the downhole tool 20. The downhole tool 20 may be any type of tools which may be used in the downhole environment of a wellbore and needs to be removed by milling after a scheduled period. The downhole tool 20 has a first tool end 21 and a second tool end 22 along a longitudinal direction which runs substantially along the wellbore 10. One example of the downhole tool 20 is a bridge plug, which may be used to seal and isolate certain sections, such as a first section of the wellbore, from other sections, such as a second section of the wellbore.

Figure 2:
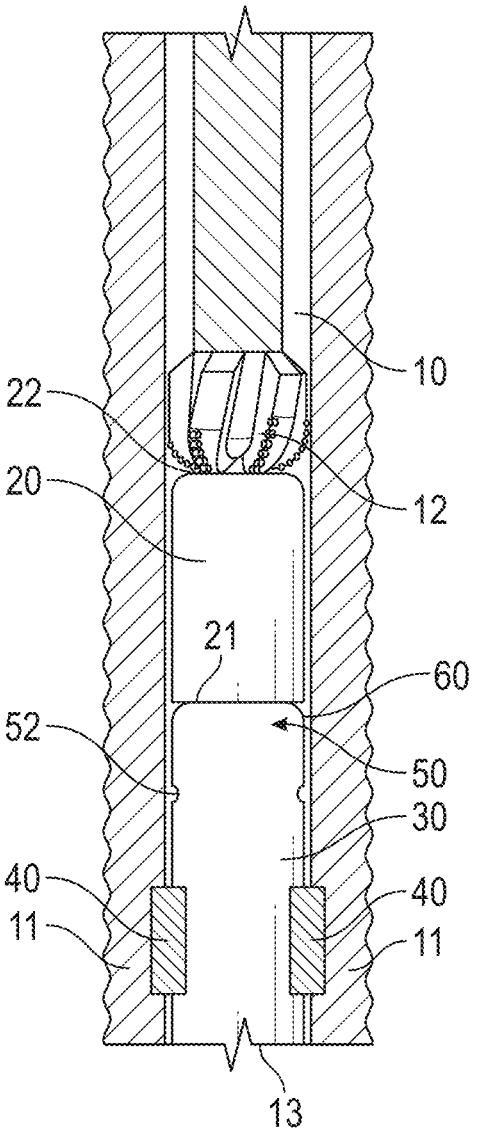
FIG. 2 shows a schematic view of the assembly of FIG. 1, in which the downhole tool is being milled by a high-pressure coil tubing (HPCT).

The gripper 30 comprises a slider 40 and an activator 50. The slider 40 is configured to move in a radial direction which is transverse to the longitudinal direction. The activator 50 is configured to move relative to the slider 40 longitudinally between an inactivated position 51 and an activated position 52. When the assembly is deployed in a wellbore 10, as shown in FIG. 1 and FIG. 2, the activator 50 may be driven to move downward along the wellbore 10 between the inactivated position 51 and the activated position 52. When the activator 50 is in the inactivated position 51 as illustrated in FIG. 1, the slider 40 remains unmoved in the gripper 30. When the activator 50 is in the activated position 52 as illustrated in FIG. 2, the slider 40 moves radially outward to engage with an internal wall 11 of the wellbore 10.

In use, the assembly comprising the downhole tool 20 and the gripper 30 fixed to the first tool end 21 of the downhole tool 20 is deployed at a predetermined position in the wellbore 10, as shown in FIG. 1. During the period of drilling, manufacturing, maintenance or other scheduled operations, the activator 50 is in the inactivated position 51, and the slider 40 remains in the gripper 30.

After scheduled operation, the assembly will be removed from the wellbore 10 by milling operation to restore well accessibility and resume production. As one example, a high-pressure coil tubing (an HPCT 12) is used to mill the assembly from the second tool end 22 of the downhole tool 20, as illustrated in FIG. 2. In the process of milling, the HPCT 12 applies to the downhole tool 20 a downward force and a rotation force. The downward force from the HPCT 12 moves the downhole tool 20 along the wellbore 10 such that the activator 50 is moved downward, as illustrated, by the downhole tool 20 from the inactivated position 51 (see FIG. 1) to the activated position 52 (see FIG. 2), and the slider 40 moves radially outward to engage with the internal wall 11 of the wellbore 10 and stops the downhole tool 20 from rotating or spinning along with the HPCT 12, as shown in FIG. 2. Thus, the energy from the milling of the HPCT 12 will be used efficiently to mill the assembly.

Figure 3:
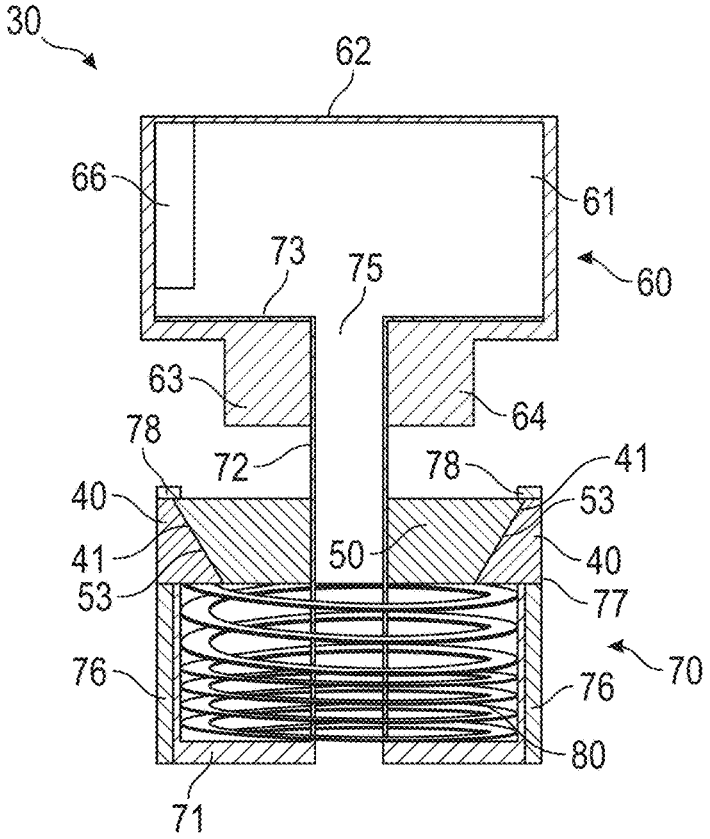
FIG. 3 shows a schematic view of a gripper for the assembly of FIG. 1 according to one or more embodiments.

FIG. 3 shows a schematic view of an exemplary gripper for the assembly of FIG. 1 according to one or more embodiments. The gripper comprises a pusher 60 configured to be fixed to the first tool end 21 of the downhole tool 20 (see FIG. 1) and a main body 70 connected to the pusher 60 in a longitudinally movable way. In this way, the pusher 60 can move along with the downhole tool 20 longitudinally and rotationally and, thus, the gripper as a whole will move a limited longitudinal distance relative to the pusher 60 and the downhole tool 20, which will be detailed below.

The pusher 60 comprises a chamber 61 and, as illustrated in FIG. 3, an upper end 62 of the chamber 61 is configured to be fixed to the first tool end 21 of the downhole tool 20 by means of, for instance, threaded connections, welding, soldering and the like. A lower end 63 of the chamber 61 is provided with a protrusion 64 directed downward to the main body 70.

The main body 70 comprises a support 71 and a stem 72 which extends from the support 71 along the longitudinal direction. The stem 72 goes along a channel in the protrusion 64 into the chamber 61. The stem 72 has a first stem end 74 extending from the support and an enlarged end 73 in the chamber 61. Thus, the main body 70 is hung below the pusher 60 by the enlarged end 73 and can be moved longitudinally relative to the pusher 60 and the downhole tool 20 via the enlarged end 73 moving in the chamber 61 between the upper end 62 and the lower end 63. A passage 75 can be provided along the length of the stem 72 for circulation of fluid when the enlarged end 73 moves longitudinally in the chamber 61 between the upper end 62 and the lower end 63. Alternatively, the stem 72 can be solid if no circulation is necessary for the chamber.

As discussed above, since the downhole tool 20 needs to be stopped from rotating or spinning by the gripper 30 when milling, a stopping structure may be constructed in the chamber. As one example, at least one of the chamber 61 and the enlarged end 73 of the stem has a square cross section. As another example, a stopper 66 may be provided in the chamber for the enlarged end 73 of the stem 72 so that the relative rotation between the stem 72 and the chamber 61 is restricted during milling.

The main body 70 further comprises a frame 76 extending longitudinally from the support 71. A radial opening 77 is provided in the frame 76 for containing the slider 40 such that the slider 40 may be supported on the main body 70 in a radially moveable way. One or more of a slider 40 may be provided on the main body. For instance, there may be four sliders distributed equally around the circumference of the frame 76.

The activator 50 is mounted around the stem 72 via a through hole of the activator 50 along the longitudinal direction and, thus, the activator 50 can move between an inactivated position and an activated position along the stem 72 longitudinally. The activator 50 is positioned between the slider 40 and a flange 78 extending inward from the frame 76, such that the activator 50 is maintained together with the main body 70. The activator 50 comprises a conical section 53 which serves as a wedge against the slider 40 when the activator 50 moves along the stem 72 in the longitudinal direction. In correspondence to the conical section 53 of the activator 50, the slider 40 has an inclined surface 41 contacting the conical section 53 of the activator 50. In this manner the slider is supported in a radially movable way on the main body. In one example, the slider is designed to be milled by the HPCT so as to ensure efficiency of milling.

The gripper further comprises a spring 80 such as a helical spring mounted around the stem 72 on the main body 70. One end of the spring 80 is supported on the support 71 and the other end of the spring 80 presses against an lower end of the slider 40 in the longitudinal direction. The activator 50 is positioned above the spring 80. When the activator 50 is moved by a downward force from an inactivated position to an activated position along the stem 72, the activator 50 contacts the upper end of the spring 80 and compresses the spring 80 to move away from the slider 40. After the downward force is let go, the activator 50 will be pressed to its inactivated position by the spring 80 as the spring relaxes from its compressed state.

It can be appreciated that, though the stem 72 of the main body 70 is shown as connected indirectly via the pusher 60 to the downhole tool 20, it is also in the invention that the stem 72 of the main body 70 is connected directly to the downhole tool 20 in a longitudinally movable way.

Below is a description of the operation of the assembly with the gripper as illustrated FIG. 3.

Figure 4:
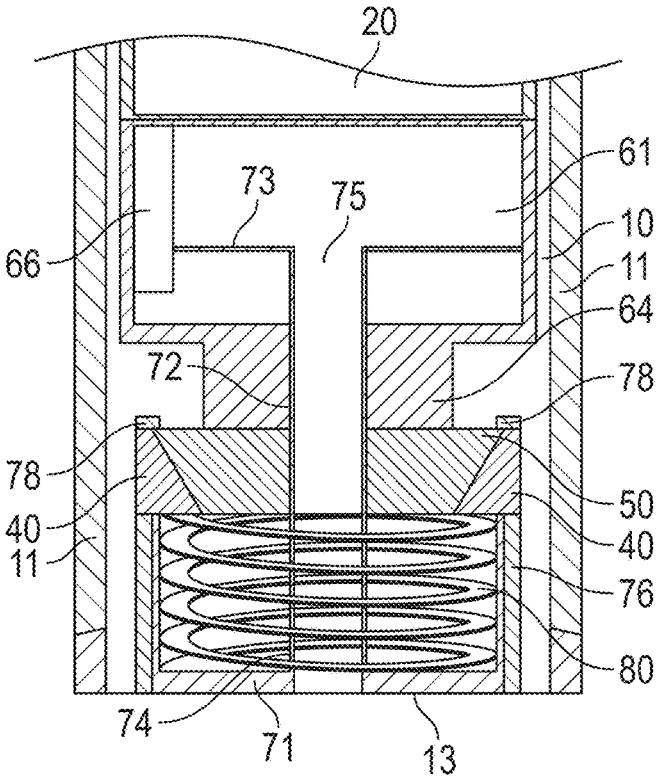
FIG. 4 shows a schematic view of the gripper of FIG. 3, in which the activator is in an inactivated position.

As illustrated in FIG. 4, under the downward force from a HPCT (see FIG. 2), the downhole tool 20 and the gripper 30 are moved together along the wellbore 10 downward until the support 71 of the main body 70 reaches a solid surface 13 in the wellbore and stops moving further. With the downhole tool 20 further moving downward due to the downward force of the HPCT, the enlarged end 73 moves in the chamber 61, and the protrusion 64 of the pusher 60 moves towards the activator 50. Before the protrusion 64 contacts and presses the activator 50, the activator 50 is in an inactivated position along the stem, and the slider 40 remains inactivated in the frame 76.

Figure 5:
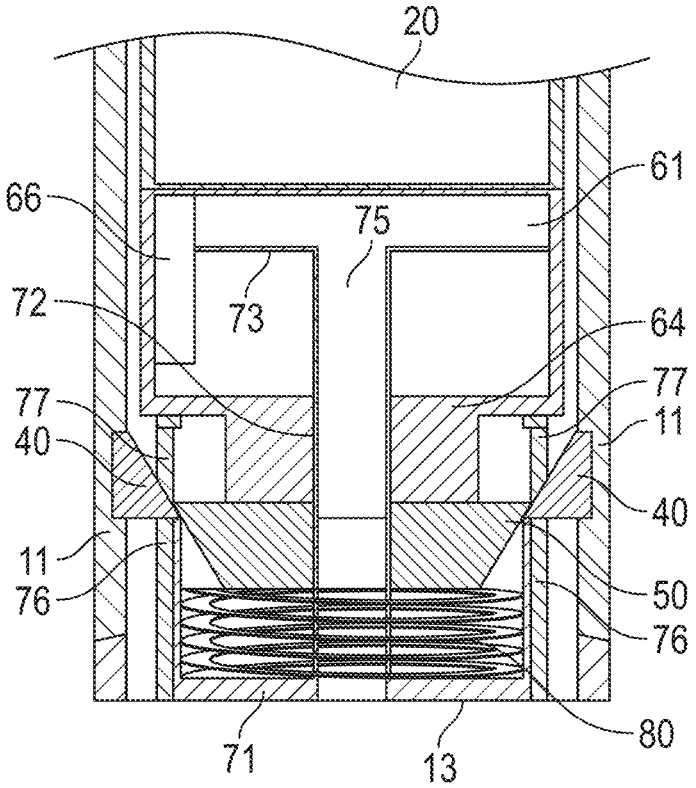
FIG. 5 shows a schematic view of the gripper of FIG. 3, in which the activator is in an activated position.

Now turn to FIG. 5. Since the support 71 is stopped from moving downward by the solid surface 13 in the wellbore, the further downward movement of the protrusion 64 drives the activator 50 to move downward relative to the frame 76 and the slider 40. After the conical section of the activator 50 applies a radial force as a wedge against the slider 40, the activator goes into the activated position such that the slider 40 moves radially outward to engage with the internal wall 11 of the wellbore 10. By means of the stopper 66 in the chamber 61, the downhole tool 20 is stopped by the slider 40 from rotating or spinning along with the HPCT and thus milling of the downhole tool 20 can be efficiently performed by the HPCT.

During the downward movement of the activator 50 relative to the frame 76 and the slider 40, the spring 80 will be pressed by the lower end of the activator 50. In case the milling operation is not successful, the HPCT can be move upward to release the downward force from the downhole tool 20, and the spring 80 can go from its compressed state back to its original state so as to move the activator 50 to its inactivated position, and the slider 40 can retract inside the frame 76 and disengage from the inner wall of the wellbore, such that the downhole tool 20 may be deployed in a new position.

Figure 6:
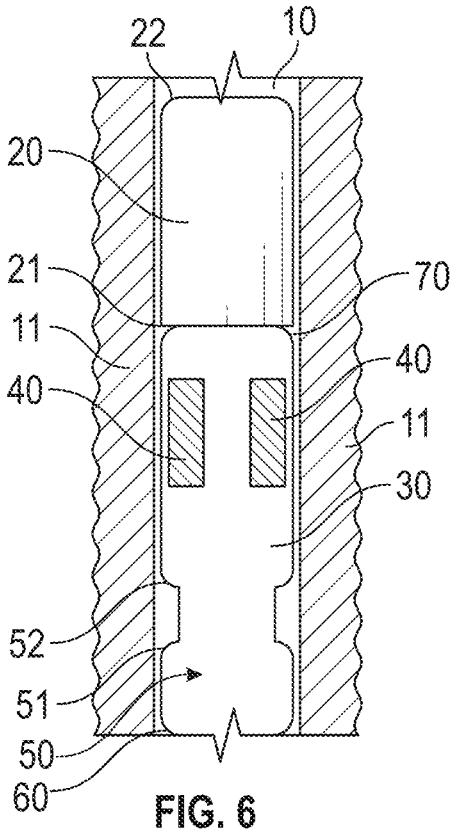
FIG. 6 shows a schematic view of another assembly according to one or more embodiments, in which the assembly comprising a downhole tool and a gripper is deployed in a wellbore.

FIG. 6 shows a schematic view of another assembly according to one or more embodiments, which assembly is used for deployment in a wellbore 10 for operations like drilling, manufacturing, or maintenance of the wellbore. The assembly comprises a downhole tool 20 and a gripper 30 connected to the downhole tool 20. The downhole tool 20 may be any type of tools which is to be used in the downhole environment of a wellbore, like manufacturing, operation, or maintenance, etc., and needs to be removed by milling after a scheduled period. The downhole tool 20 has a first tool end 21 and a second tool end 22 along a longitudinal direction which runs substantially along the wellbore 10. One example of the downhole tool 20 is a bridge plug, which can be used to seal and isolate certain sections, such as a first section of the wellbore, from other sections, such as a second section of the wellbore.

Figure 7:
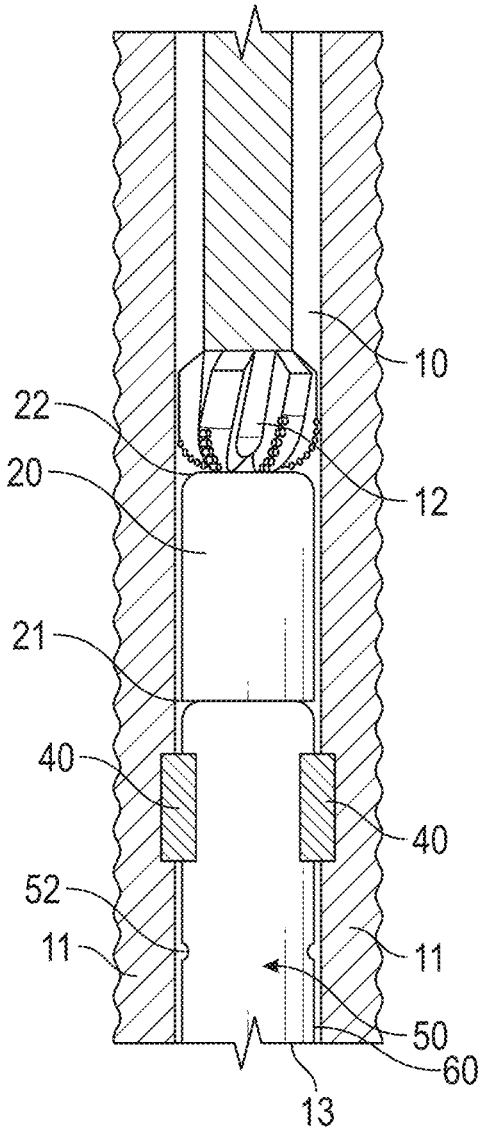
FIG. 7 shows a schematic view of the assembly of FIG. 6, in which the downhole tool is being milled by a high-pressure coil tubing (HPCT).

The gripper 30 comprises a slider 40 and an activator 50. The slider 40 is configured to move in a radial direction which is transverse to the longitudinal direction. The activator 50 is configured to move relative to the slider 40 longitudinally between an inactivated position 51 and an activated position 52. When the assembly is deployed in a wellbore 10, as shown in FIG. 6 and FIG. 7, the activator 50 will be driven to move upward along the wellbore 10 between the inactivated position 51 and the activated position 52. When the activator 50 is in the inactivated position 51 as illustrated in FIG. 6, the slider 40 remains unmoved in the gripper. When the activator 50 is in the activated position 52 as illustrated in FIG. 7, the slider 40 moves radially outward to engage with an internal wall 11 of the wellbore 10.

In use, the assembly comprising the downhole tool 20 and the gripper 30 fixed to the first tool end 21 of the downhole tool 20 is deployed at a predetermined position along the wellbore 10, as shown in FIG. 6. During the period of drilling, manufacturing, maintenance or other scheduled operation, the activator 50 is in the inactivated position 51, and the slider 40 remains in the gripper 30.

After scheduled operation, the assembly will be removed from the wellbore 10 by milling to restore well accessibility and resume production. As one example, HPCT 12 is used to mill the assembly from the second tool end 22 of the downhole tool 20, as illustrated in FIG. 7. In the process of milling, the HPCT 12 applies to the downhole tool 20 a downward force and a rotation force. The downward force from the HPCT 12 moves the downhole tool 20 along the wellbore 10 such that the activator 50 is moved by the downhole tool 20 upward, as illustrated, from the inactivated position 51 (see FIG. 6) to the activated position 52 (see FIG. 7), and the slider 40 moves radially outward to engage with the internal wall 11 of the wellbore 10 and stops the downhole tool 20 from rotating or spinning along with the HPCT 12. Thus, the energy from the milling of the HPCT 12 will be used efficiently to mill the assembly.

Figure 8:
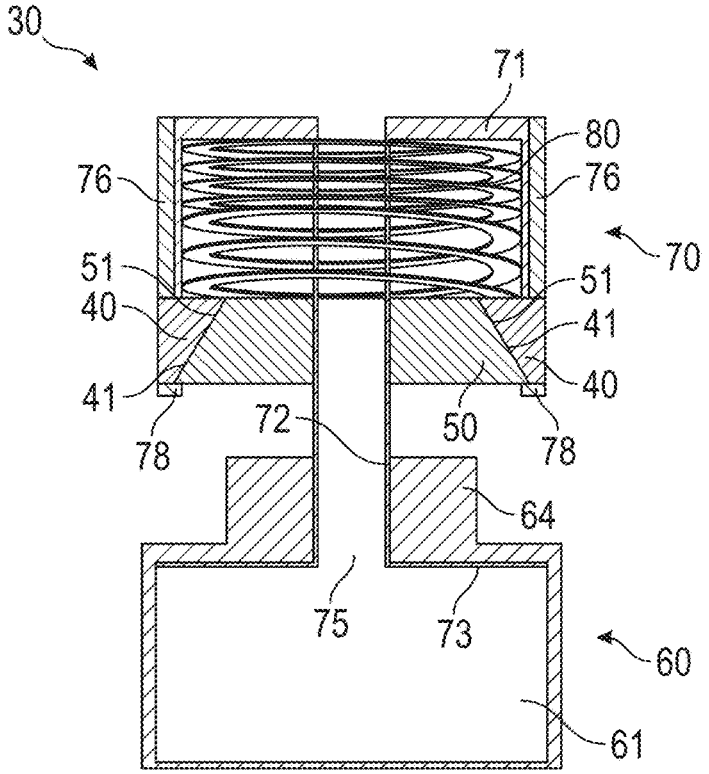
FIG. 8 shows a schematic view of the gripper for the assembly of FIG. 6 according to one or more embodiments.

FIG. 8 shows a schematic view of an exemplary gripper for the assembly of FIG. 6 according to one or more embodiments. The gripper comprises a main body 70 configured to be fixed to the first tool end 21 of the downhole tool 20 (see FIG. 9) and a pusher 60 connected to the main body 70 in a longitudinally movable way. In this way, the main body 70 can move a limited longitudinal distance along with the downhole tool 20 relative to the pusher 60, which will be detailed below.

Figure 9:
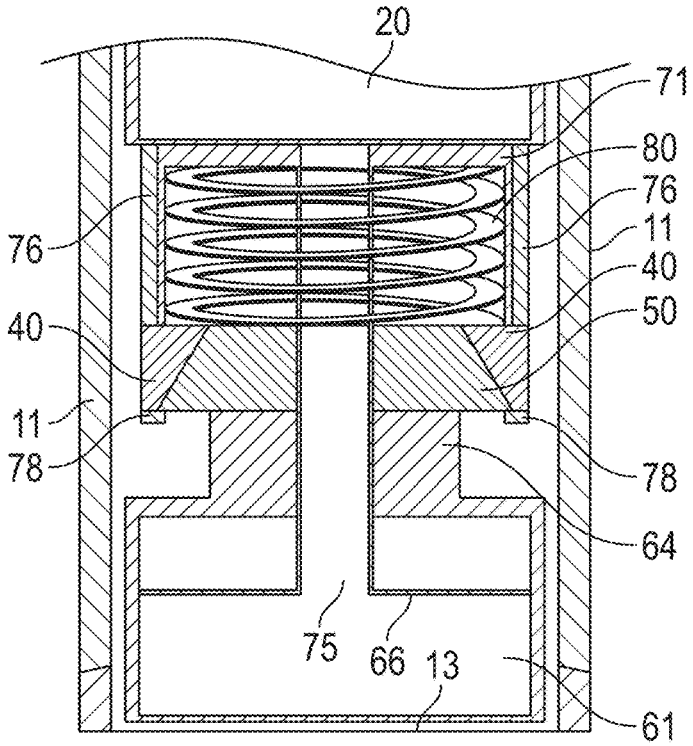
FIG. 9 shows a schematic view of the gripper of FIG. 8, in which the activator is in an inactivated position.

The pusher 60 comprises a chamber 61 and, as shown in the figure, an upper end 62 of the chamber 61 is provided with a protrusion 64 directed upward to the main body 70 and a lower end 63 of the chamber 61 is configured to be supported on a solid surface 13 in the wellbore 10 (see FIG. 9).

The main body 70 comprises a support 71 and a stem 72 which extends from the support 71 along the longitudinal direction. The stem 72 goes along a channel in the protrusion 64 into the chamber 61. The stem 72 has an enlarged end 73 in the chamber 61. Thus, the pusher 60 is hung below the main body 70 by the enlarged end 73 and can be moved longitudinally relative to the main body 70 and the downhole tool 20 via the enlarged end 73 moving in the chamber 61 between the upper end and the lower end. A passage 75 can be provided along the length of the stem 72 for circulation of fluid in the chamber 61 when the enlarged end 73 moves longitudinally between the upper end and the lower end of the chamber 61. Alternatively, the stem 72 can be solid if no circulation is necessary for the chamber.

The main body 70 further comprises a frame 76 extending longitudinally from the support 71. A radial opening 77 (see FIG. 10) is provided in the frame 76 for containing the slider 40 such that the slider 40 may be supported on the main body 70 in a radially moveable way. One or more of the slider 40 may be provided on the main body. For instance, there can be three sliders distributed equally around the circumference of the frame 76. For instance, there can be three sliders distributed equally around the circumference of the frame. The sliders may be maintained in the frame by any known means. As one example, an elastic band is wrapped around the frame such that the sliders are maintained in the frame and can be moved outward radially by the activator.

The activator 50 is mounted around the stem 72 via a through hole of the activator 50 along the longitudinal direction and, thus, the activator 50 can move between an inactivated position and an activated position along the stem 72 longitudinally. The activator 50 is positioned between a flange 78 extending inward from the frame 76 and the slider 40, such that the activator 50 is maintained together with the main body 70. The activator 50 comprises a conical section 53 which serves as a wedge against the slider 40 when the activator 50 moves along the stem 72 longitudinally. In correspondence to the conical section 53 of the activator 50, the slider 40 has an inclined surface 41 contacting the conical section 53 of the activator 50. In one example, the slider 40 is designed to be milled by the HPCT so as to ensure efficiency of milling.

The gripper further comprises a spring 80 such as a helical spring mounted around the stem 72 on the main body 70. One end of the spring 80 presses against the support 71 and the other end of the spring 80 is supported on an upper end of the slider 40 in the longitudinal direction. The activator 50 is positioned below the spring 80. When the activator 50 is moved by an upward force of the pusher 60 from an inactivated position to an activated position along the stem 72, the activator 50 contacts the lower end of the spring 80 and compresses the spring 80 to move away from the slider 40. After the upward force is let go, the activator 50 will be pressed to its inactivated position by the spring 80 as the spring relaxes from its compressed state.

As illustrated in FIG. 9, under the downward force from a HPCT (see FIG. 7), the downhole tool 20 and the gripper 30 are moved together along the wellbore downward until the pusher 60 reaches a solid surface 13 in the wellbore 10 and stops moving further. With the downhole tool 20 further moving downward due to the downward force of the HPCT, the enlarged end 73 moves downward in the chamber 61, and the protrusion 64 of the pusher 60 moves towards the activator 50. Before the protrusion 64 contacts and presses the activator 50, the activator 50 is in an inactivated position along the stem and the slider 40 remains inactivated in the frame 76.

Figure 10:
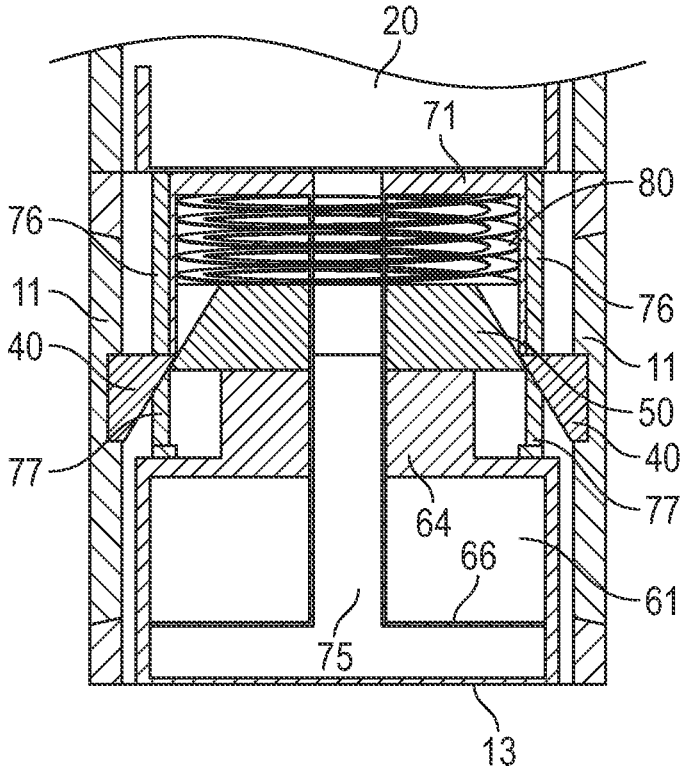
FIG. 10 shows a schematic view of the gripper of FIG. 8, in which the activator is in an activated position.

Now turn to FIG. 10. Since the pusher 60 is stopped from moving downward by the solid surface 13 in the wellbore 10, the further downward movement of the main body drives the activator 50 to move upward relative to the frame 76 and the slider 40, and the conical section of the activator 50 serves as a wedge against the slider 40. After the conical section 53 of the activator 50 applies a radial force as a wedge against the slider 40, the activator goes into the activated position such that the slider 40 moves radially outward to engage with the internal wall 11 of the wellbore 10. Since the main body is fixed to the downhole tool, the downhole tool 20 is stopped by the slider 40 from rotating or spinning along with the HPCT and thus milling of the downhole tool 20 can be efficiently performed by the HPCT.

During the upward movement of the activator 50 relative to the frame 76 and the slider 40, the spring 80 will be pressed by the activator 50. In case the milling operation is not success for, the HPCT can be move upward to release the downward force from the downhole tool 20, and the spring 80 can go from its compressed state back to its original state so as to move the activator 50 to its inactivated position, and the slider 40 can retract inside the frame 76 and disengage from the inner wall of the wellbore, such that the downhole tool 20 may be deployed in a new position.

Figure 11:
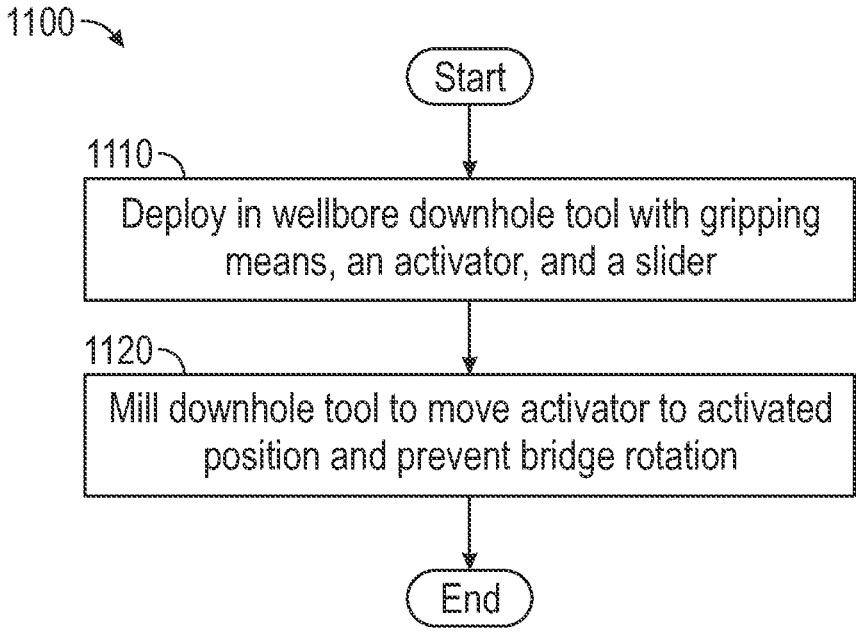
FIG. 11 shows a flowchart in accordance with one or more embodiments.

FIG. 11 is a flowchart depicting, in accordance with one or more embodiments, a method 1100 for isolating one section from another section in a wellbore for a scheduled period. One or more blocks in FIG. 11 may be performed using one or more components as described in FIGS. 1 through 10. While the various blocks in FIG. 11 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In block 1110 a downhole tool (20) is deployed at a predetermined position in the wellbore 10. Downhole tool (20) may be such as a bridge plug with gripper (30) fixed to a first tool end (21) of the bridge plug. The gripper (30) may have an activator (50) and a slider (40).

In block 1120 the downhole tool (20) such as a bridge plug is milled, after the scheduled period, from a second tool end (22) of the bridge plug such that the activator (50) is moved by the bridge plug from an inactivated position (51) to an activated position (52). The slider (40) remains unmoved when the activator (50) is in the inactivated position (51), and the slider moves radially to engage with an internal wall (11) of the wellbore (10) and stop the bridge plug from rotation when the activator (50) is in the activated position (52).

While the disclosure has been described with respect to a limited number of embodiments, those skilled in the art, having benefit of this disclosure will appreciate that other embodiments can be devised which do not depart from the scope of the disclosure. Accordingly, the scope of the disclosure should be limited only by the attached claims.

What is claimed is:

1. An assembly, comprising:

a downhole tool deployed at a predetermined position in a wellbore and configured to be milled after a scheduled period, wherein the downhole tool has a first tool end and a second tool end along a longitudinal direction;

a gripper fixed to the first tool end along the longitudinal direction, wherein the gripper comprises an activator, a slider, a support, a frame, and a helical spring between the activator and the support;

wherein the support and the frame are configured to support the slider in a radially moveable way;

wherein a downward force from a milling tool applied to the downhole tool moves the downhole tool and the gripper longitudinally along the wellbore until the support reaches a solid surface and stops the support from further longitudinal movement;

wherein the activator is configured to be moved by the downhole tool relative to the slider between an inactivated position and an activated position when the downhole tool is milled, after the scheduled period, from the second tool end thereby compressing the helical spring from an original state to a compressed state;

wherein the slider remains unmoved when the activator is in the inactivated position, and the slider moves radially to engage with an internal wall of the wellbore and stop the downhole tool from rotation when the activator is in the activated position;

wherein the helical spring is configured to relax from the compressed state to the original state upon release of the downward force; and wherein the relaxing of the helical spring from the compressed state to the original state is configured to move the activator from the activated position to the inactivated position thereby retracting the slider radially to disengage the slider from the internal wall.

2. The assembly of claim 1, wherein the gripper further comprises a pusher fixed to the first tool end and a main body connected in a longitudinally movable way to the pusher, and wherein the slider is supported in a radially movable way on the main body and the activator is supported in the longitudinally movable way on the main body;

wherein the pusher is configured to push the activator from the inactivated position to the activated position when the downhole tool is milled from the second tool end.

3. The assembly of claim 2, wherein the main body comprises a stem;

wherein the stem has a first stem end extending from the support and a second stem end connected in the longitudinally movable way to the first tool end.

4. The assembly of claim 3, wherein the pusher comprises a chamber fixed to the first tool end;

wherein the second stem end is an enlarged end contained in the chamber in the longitudinally movable way;

wherein the chamber comprises a stopper for restricting relative rotation between the chamber and the enlarged end.

5. The assembly of claim 2, wherein the activator has a conical section configured to serve as a wedge against the slider when the activator moves from the inactivated position to the activated position.

6. The assembly of claim 5, wherein the activator is restricted between the slider and a flange extending inward from the main body.

7. The assembly of claim 1, wherein the downhole tool is a bridge plug for isolating a first section of the wellbore from a second section of the wellbore.

8. The assembly of claim 1, wherein the gripper comprises a main body fixed to the first tool end and a pusher connected in a longitudinally movable way to the main body, and wherein the slider is supported in a radially movable way on the main body, and the activator is supported in the longitudinally movable way on the main body, wherein the pusher is configured to push the activator from the inactivated position to the activated position when the downhole tool is milled from the second tool end of the downhole tool.

9. The assembly of claim 8, wherein the pusher comprises a chamber, wherein the main body comprises a stem, wherein the stem has a first stem end extending from the support and a second stem end being an enlarged end contained in the chamber in the longitudinally movable way.

10. A gripper for use with a downhole tool, wherein the downhole tool is deployed at a predetermined position in a wellbore and is configured to be milled after a scheduled period, wherein the downhole tool has a first tool end and a second tool end along a longitudinal direction, wherein the gripper is fixed to the first tool end along the longitudinal direction, the gripper comprising: an activator; a slider; a support; a frame; and a helical spring between the activator and the support, wherein the support and the frame are configured to support the slider in a radially moveable way;

wherein a downward force from a milling tool applied to the downhole tool moves the downhole tool and the gripper longitudinally along the wellbore until the support reaches a solid surface and stops the support from further longitudinal movement;

wherein the activator is configured to be moved by the downhole tool relative to the slider between an inactivated position and an activated position when the downhole tool is milled, after the scheduled period, from the second tool end thereby compressing the helical spring from an original state to a compressed state;

wherein the slider remains unmoved when the activator is in the inactivated position and the slider moves radially to engage with an internal wall of the wellbore and stop the downhole tool from rotation when the activator is in the activated position;

wherein the helical spring is configured to relax from the compressed state to the original state upon release of the downward force; and wherein the relaxing of the helical spring from the compressed state to the original state is configured to move the activator from the activated position to the inactivated position thereby retracting the slider radially to disengage the slider from the internal wall.

11. The gripper of claim 10, further comprises:

a pusher fixed to the first tool end;

a main body connected in a longitudinally movable way to the first tool end; and wherein the slider is supported in a radially movable way on the main body and the activator is supported in the longitudinally movable way on the main body;

wherein the pusher is configured to push the activator from the inactivated position to the activated position when the downhole tool is milled from the second tool end.

12. The gripper of claim 11, wherein the main body comprises a stem;

wherein the stem has a first stem end extending from the support and a second stem end connected in the longitudinally movable way to the first tool end.

13. The gripper of claim 12, wherein the pusher comprises a chamber fixed to the first tool end;

wherein the second stem end is an enlarged end contained in the chamber in the longitudinally movable way.

14. The gripper of claim 13, wherein the chamber comprises a stopper for restricting relative rotation between the chamber and the enlarged end.

15. The gripper of claim 10, wherein the activator has a conical section configured to serve as a wedge against the slider when the activator moves from the inactivated position to the activated position.

16. The gripper of claim 10, further comprising:

a main body fixed to the first tool end;

a pusher connected in a longitudinally movable way to the main body; and wherein the slider is supported in a radially movable way on the main body, and the activator is supported in a movable longitudinally way on the main body, wherein the pusher is configured to push the activator from the inactivated position to the activated position when the downhole tool is milled from the second tool end of the downhole tool.

17. The gripper of claim 16, wherein the pusher comprises a chamber, and wherein the main body comprises a stem, wherein the stem has a first stem end extending from the support and a second stem end being an enlarged end contained in the chamber in the longitudinally movable way.

18. A method for isolating a first section of a wellbore from a second section of the wellbore for a scheduled period, the method comprising:

deploying at a predetermined position in the wellbore a bridge plug with a gripper fixed to a first end of the bridge plug, wherein the gripper comprises an activator, a slider, a support, and a helical spring between the activator and the support;

applying a downward force from a milling tool to the bridge plug;

moving, using the downward force, the bridge plug and the gripper longitudinally along the wellbore until the support reaches a solid surface and stops the support from further longitudinal movement;

milling, after the scheduled period, from a second end of the bridge plug such that the activator is moved by the bridge plug from an inactivated position to an activated position thereby compressing the helical spring from an original state to a compressed state, wherein the slider remains unmoved when the activator is in the inactivated position, and the slider moves radially to engage with an internal wall of the wellbore and stop the bridge plug from rotation when the activator is in the activated position;

releasing the downward force thereby relaxing the helical spring from the compressed state to the original state;

moving, using the helical spring in the original state, the activator from the activated position to the inactivated position thereby retracting the slider radially, and disengaging the slider from the internal wall.

* * * * *